US005647149A

United States Patent [19]

Dalebout

[11] Patent Number: 5,647,149

[45] Date of Patent: Jul. 15, 1997

[54] SPORT BOOT INNER LINER

[75] Inventor: Melvin W. Dalebout, Salt Lake City, Utah

[73] Assignee: Daleboot USA, Salt Lake City, Utah

[21] Appl. No.: 201,779

[22] Filed: Feb. 25, 1994

[51] Int. Cl.[6] ..... A43B 3/10; A43B 23/07; A43B 5/04

[52] U.S. Cl. ..... 36/117.1; 36/10; 36/55; 36/93

[58] Field of Search ..... 36/117, 119, 55, 36/10, 83, 71, 93, 109, 115, 120, 54

[56] References Cited

U.S. PATENT DOCUMENTS

| | | | |
|---|---|---|---|
| 2,244,030 | 6/1941 | Teehan | 36/54 |
| 3,667,140 | 6/1972 | Hunderford | 36/71 |
| 3,750,310 | 8/1973 | Messner et al. | 36/119 |
| 3,858,337 | 1/1975 | Vogel | 36/55 |
| 4,078,322 | 3/1978 | Dalebout | 36/10 |
| 4,182,056 | 1/1980 | Dalebout | 36/71 |
| 4,268,931 | 5/1981 | Salomon | 36/10 |
| 4,509,276 | 4/1985 | Bourque | 36/115 |
| 4,655,465 | 4/1987 | Schaeffer | 36/10 |
| 4,893,417 | 1/1990 | Dalla Lana | 36/10 |
| 4,920,666 | 5/1990 | Marega | 36/10 |
| 5,050,319 | 9/1991 | Perotto et al. | 36/55 |
| 5,337,493 | 8/1994 | Hill | 36/54 |

FOREIGN PATENT DOCUMENTS

| | | | |
|---|---|---|---|
| 2541095 | 8/1984 | France | 36/119 |
| 3429284 | 2/1986 | Germany | 36/119 |

*Primary Examiner*—M. D. Patterson
*Attorney, Agent, or Firm*—Trask, Britt & Rossa

[57] ABSTRACT

For sport boot systems incorporating a pliable inner liner within a rigid outer shell, such as for ski or snow board type boots, an inner liner of foam material is provided with a single bifurcation at its outer side to provide a tongueless entry access opening. Relief structures are positioned at the front of the liner to provide enhanced forward flexibility and to increase comfort.

21 Claims, 1 Drawing Sheet

SPORT BOOT INNER LINER

BACKGROUND OF THE INVENTION

1. Field

This invention relates in general to boot systems utilizing a relatively stiff outer shell and a removable flexible inner liner, and particularly to sport boots such as used for the sports of skiing and snow boarding.

2. State of the Art

Over the past several years, ski boots have evolved through several stages from stiff unlined boots of leather to the present rigid outer shells (generally of plastic) with flexible inner liners of various types. For use with modern bindings, it is essential that the outer shell be stiff to optimize the control effected on the skis by a skier shifting his weight or the attitude of his feet. The inner liner provides for adequate comfort so that the skier can tolerate wearing the boots for extended periods. Similar considerations are involved in the design of other sport boots, notably those used for snow boarding.

Various ski boot inner liners are disclosed by U.S. Pat. Nos. 4,078,322; 3,786,580; and 4,038,762; the disclosures of which are incorporated by reference for their teachings concerning the construction of ski boot inner liners generally. FIG. 1 of U.S. Pat. No. 4,078,322 illustrates a representative outer shell and inner liner ski boot system as typically assembled for use.

Several approaches to inner liner construction have been tried to achieve the desired combination of foot support, ease of forward ankle movement, and adequate comfort for the skier. Thus far, no approach has been entirely successful. U.S. Pat. No. 4,078,322 is generally instructive, and FIG. 3 of that patent discloses a representative currently available inner liner. The assembly line manufactured liner disclosed is removable from an associated outer shell. It is constructed of a soft closed-cell (i.e., micro cellular) foam material. Closed-cell foam provides cushioning, support, and insulation to keep a skier's foot comfortable and warm for extended periods of time. Spacing tabs are provided in the vicinity of the lower ankle to ensure a snug fit around the heel, and the liner is slit down the front to facilitate foot entry without a tongue. Avoiding the use of a tongue provides a substantially continuous smooth inner surface against the front of a skier's leg, and eliminates the discomfort that routinely occurs when the edges of the tongue of previous ski boot designs press into the front of a skier's leg. Even greater discomfort may be experienced if the tongue happens to slip to the side, with repeated flexing of a skier's ankles.

While the tongueless design represents an improvement in comfort to the user, some discomfort remains due to the presence of the seam formed on closing the front entry slit. Front closure seams are inevitably distorted into bumps or ridges in the high pressure area at the front of a skier's leg as the skier flexes his ankles while skiing. Another problem associated with the front entry tongueless design is the difficulty associated in opening the liner sufficiently, especially while restrained by the surrounding boot shell, to easily insert a foot. Typically, the ball of a skier's foot is much wider than the liner ankle area it must pass through to gain entry into the assembled boot.

Foam inner liners are highly desirable for the warmth, comfort, and support they can provide. However, the liner wall thickness associated with such liners creates resistance to the forward ankle flexure which is necessary for proper control of skis. There remains the need in ski and other sport boot inner liners for increased forward flexibility, increased comfort at the front pressure point of a participant's leg, and improved foot access to the interior of the liner.

Inner liner systems have been sold with ski boots for many years. Various techniques have been used to custom fit inner liners to individual feet; such as manufacturing design modification of assembly line produced liners, use of fitting pads, or totally custom molded liners; as disclosed in U.S. Pat. Nos. 4,078,322, 3,786,580, and 4,038,762, respectively. This invention provides improvements in design applicable to any of these inner liner systems.

SUMMARY OF THE INVENTION

The present invention provides a sport boot system comprising a pliable inner liner within a relatively rigid outer shell, and provides substantial improvement over systems of the prior art. The inner liner of this invention provides increased flexibility for forward ankle flexure, increased comfort at the front pressure point of an athlete's leg, and improved foot access to the interior of the liner. The tightening and fastening means for the entire boot system may be confined to the outer shell.

For sport boot systems incorporating a pliable inner liner within a rigid outer shell, the present invention provides an improved pliable inner liner of foam material. The inner liner is configured as a tongueless boot having leg and ankle areas with inner side, outer side, front, and back exterior surfaces and a foot area with top, bottom, toe, heel, inner side, and outer side surfaces. There is a single bifurcation at the outer side of the liner to provide an entry access opening. The bifurcation comprises first and second edges constructed and arranged to permit the inner liner to be adjusted selectively to open and closed positions, the edges being approximately juxtaposed when placed into the closed position, whereby to form a substantially ridge free seam. Only one closure seam is formed in the essentially continuously smooth liner surface contacting the foot in the single bifurcation, or tongueless, design. An important improvement in comfort is realized by specifically placing the bifurcation on the outer side of the liner, away from the high pressure areas that occur at the front and inner side of the liner.

The bifurcation includes means for effecting a substantially ridge free seam on closure of the bifurcation. While several options for providing a ridge free seam are within contemplation, the presently preferred embodiment of a bifurcation closure means includes a first edge overlapping a second edge. The overlapping portion of the first edge is received by a recessed portion of the second edge.

Tightening and fastening means carried on the outer shell of the boot system may be used to position and maintain the inner shell closure seam in the closed position. The overlapping portion of the first edge may be urged into and then restrained in place over the second edge through the agency of forces placed on the exterior surfaces of the inner liner as the outer shell of the boot system is fastened shut. The overlapping portion of the first edge and the recessed portion of the second edge should be structured and arranged so that the seam formed by closing the first edge over the second edge does not contain extra bulk compared to the surrounding liner. Eliminating bulk from the seam avoids introducing a pressure point against the foot and leg.

Mechanical closing structures, such as buckles, normally carried by an outer shell may constitute means for urging the first and second edges into position to form a ridge free seam when the bifurcation is placed in its closed position. A ridge free seam is formed by the first edge of the bifurcation overlapping the second edge of the bifurcation, the overlapping portion of the first edge being received by a recessed portion of the second edge. Pressure applied against the exterior surfaces of the liner by the outer shell as the closing structures are operated clasps the inner liner into its closed position.

The improved liner of this invention may also include means for providing enhanced forward flexibility from the ankle area of the liner. Such means ordinarily comprises at least one relief structure integral with the front of the inner liner. An exemplary such means includes a plurality of shallow, substantially horizontal relief grooves formed in the surface and at the front of the inner liner. At least one, and typically several, relief structures are placed in the outer surface of the liner to minimize the flexure restraining effects of liner wall thickness. Relief structures may take the form of shallow, substantially horizontal relief grooves and may be placed at the front of the liner in the area of curvature between foot and leg. Several shallow relief grooves are typically used to spread the flexure of the liner over a larger area and to prevent fold formation in the region of greatest flexure.

Many embodiments are contemplated for the inner liner of this invention. Ski boots and snow board boots are the most common embodiments envisioned; however the liner may also be useful for ice skate, roller skate, roller blade, cross-country ski, snowmobile, hunting, wading, or general snow boot systems. Because the embodiments of most current interest are ski boot systems, and because snow board boot systems are developing from ski boot designs, this disclosure makes primary reference to ski boot systems as a representative example.

An additional advantage provided for by the relocation of the liner opening to the outside of the foot is that any relief structures contemplated may then be placed in the full thickness of the liner rather than in the respective bifurcation edges. Locating the relief structures in an area of full liner wall thickness results in improved durability of the structures and liner throughout an extended period of use. It is typical practice for the bifurcation edges of an inner liner to be ground after molding. Such grinding is considered necessary to assure a comfortable (bulk free) fit in the closed seam. With the bifurcation located at the front of the liner, as is currently typical, grinding the bifurcation edges would remove portions of the relief structures. Locating the bifurcation away from the front portion of the liner thus provides an improvement in the manufacturability of liners containing the relief structures contemplated by this invention.

An improved inner liner of this invention may be provided in combination with fitting structure constructed and arranged for positioning adjacent an outside surface of the liner. This fitting structure may be in the form of shims or injectable pliable containers or bags. In either case, they facilitate or permit custom fitting of the inner liner to an individual's foot positioned within the liner. A rigid outer shell is constructed and arranged to receive the inner liner and the fitting structure so that the fitting structure is positioned between an inner surface of the outer shell and the outer surface of the inner liner. In some instances, a reservoir may be formed integral with the inner liner to receive injectable fluids or resins.

BRIEF DESCRIPTION OF THE DRAWINGS

In the drawings, which illustrate what is presently regarded as the best mode for carrying out the invention.

DESCRIPTION OF THE ILLUSTRATED EMBODIMENTS

Figure 1:
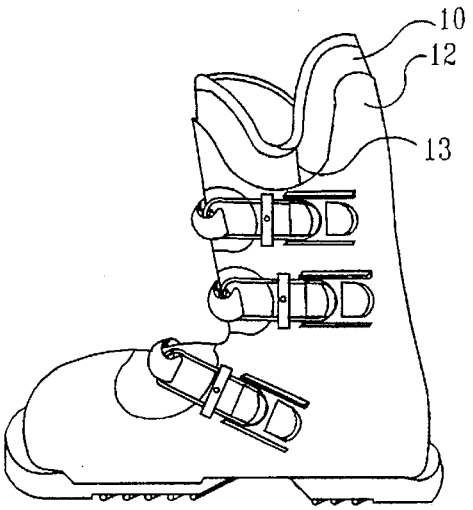
FIG. 1 is a side elevation view of a typical sport boot outer shell and an inner liner system of the invention in fully assembled condition.
Figure 2:
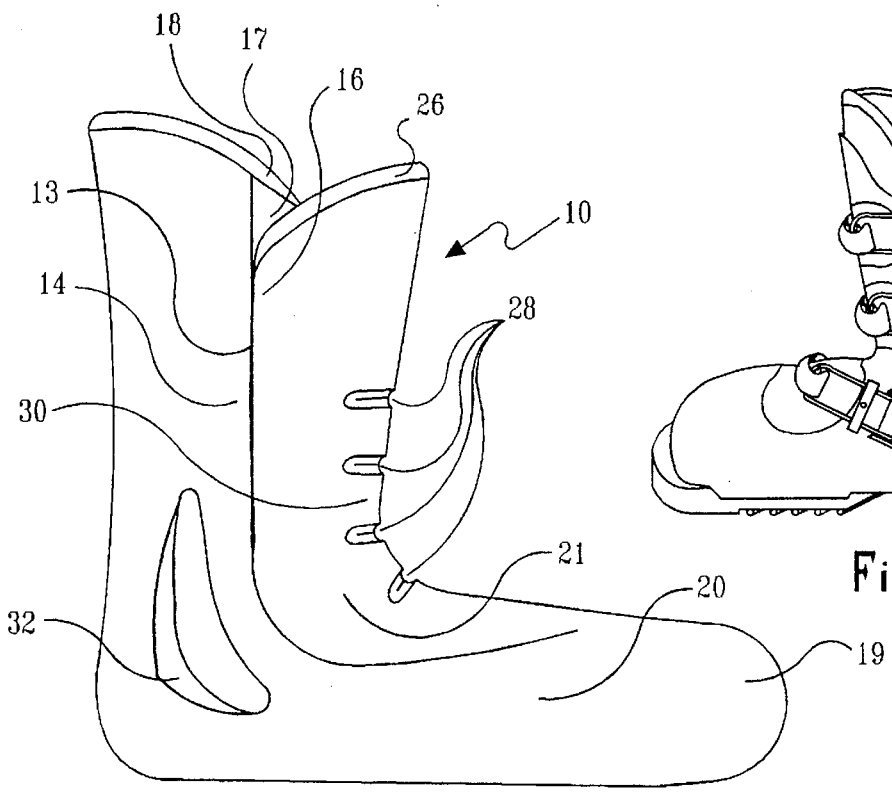
FIG. 2 is a view in perspective of an inner boot of this invention.
Figure 3:
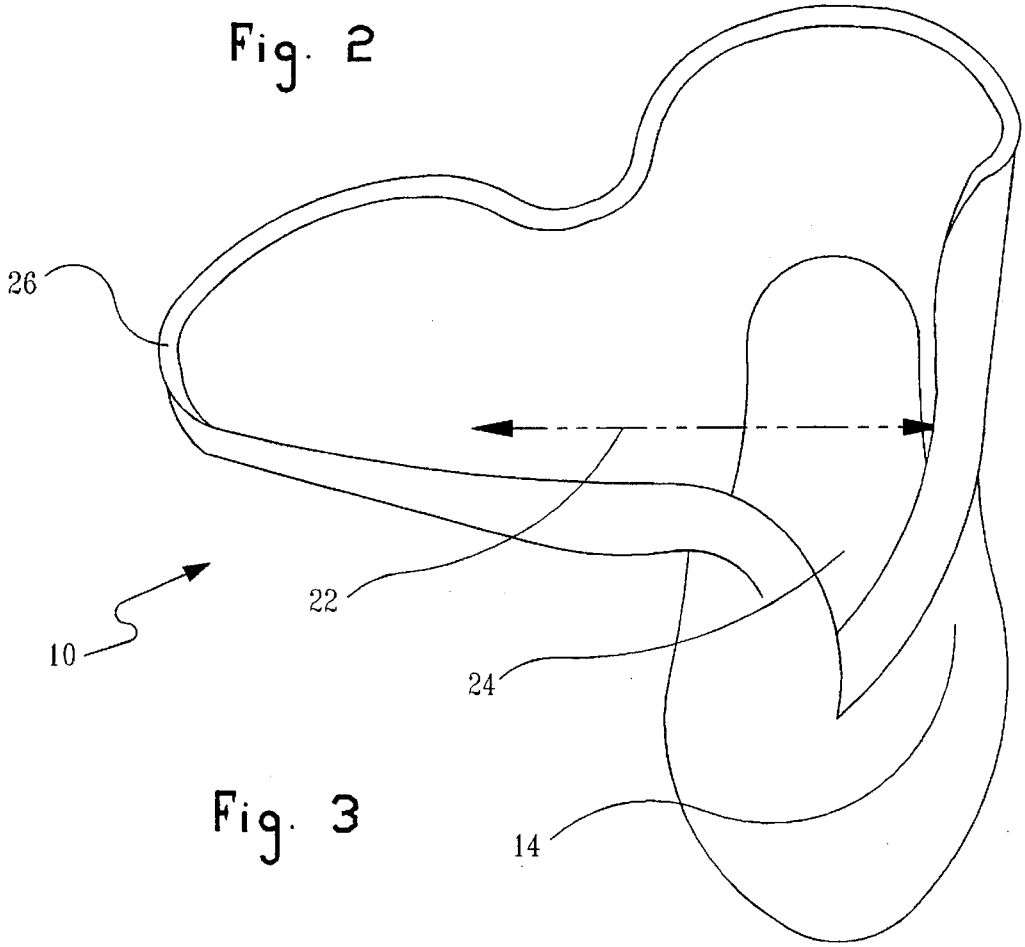
FIG. 3 is a view in perspective of the inner boot of FIG. 2, in the opened position.

FIG. 1 shows a fully assembled sport boot including a pliable inner liner 10 of this invention within a rigid outer shell 12. The inner liner 10, as illustrated in FIGS. 2 and 3, has a bifurcation 13 at the outer side 14 with an outer flap 16 adapted to seat into a recess 17 provided in an inner flap 18. The inner liner 10 thus avoids the use of a separate tongue and provides a substantially continuous smooth inner surface against the front and inside of a skier's leg.

The bifurcation 13 begins just behind the area of liner 10 enclosing a foot's toe area 19, immediately curves toward the outer side of the foot area 20, and travels off of the top of the foot area 20 of the liner well before reaching the ankle area 21. The bifurcation 13 travels along the outer side of the foot area 20 and then curves upward to the top of the liner 10 through the outer side 14 of the liner 10 in the leg area. The bifurcation 13 travel path through the liner avoids the front or inner sides of the ankle and leg areas.

Locating the inner liner 10 bifurcation 13 at the outer side 14 of the liner provides a wider opening 22, FIG. 3, for foot access to the interior 24 of the liner 10. The liner also features a structure designed to decrease forward flexure resistance from the relative thickness of the liner 10 wall 26. For example, in the illustrated embodiment, shallow, substantially horizontal relief grooves 28 are provided in the front 30 of liner 10 to facilitate flexure of the liner as a participant leans forward from the ankles. In addition, shims 32 (pads, injectable bags, cushions, etc), FIGS. 2 & 3, may be used in combination with the liner to customize the fit of a liner 10 inside an outer shell 12 for each individual participant's feet.

What is claimed is:

1. A sport boot system comprising:

a pliable inner liner within a rigid outer shell:

said pliable inner liner being constructed of foam material and being configured as a tongueless boot having leg and ankle areas, each having inner side, outer side, front, and back portions;

said outer shell including tightening and fastening means; and said inner liner including a single bifurcation at said outer side of said leg and ankle areas, said bifurcation being constructed and arranged to permit said inner liner to be adjusted selectively to open and closed positions, respectively, and comprising first and second edges, said edges being approximately juxtaposed when said inner liner is placed into said closed position, whereby to form a substantially ridge free seam.

2. A system according to claim 1, including:

structural means for forming said ridge free seam when said inner liner is in said closed position.

3. A system according to claim 2, wherein said means for forming said ridge free seam includes:

said first edge of said bifurcation overlapping said second edge of said bifurcation, the overlapping portion of said first edge being received by a recessed portion of said second edge; and means for urging and retaining said first edge in position over said second edge to achieve and retain said ridge free seam.

4. A system according to claim 3, wherein said means for urging and retaining said first edge in said position over said second edge consists of pressure against exterior surfaces of said inner liner by said outer shell under influence of outer shell tightening and fastening means.

5. A system according to claim 1, including means for providing enhanced forward flexibility from said ankle area of said liner.

6. A system according to claim 5, wherein said means for providing enhanced forward flexibility includes at least one non-bifurcated relief structure at said front ankle area of said liner.

7. A system according to claim 5, wherein said means for providing enhanced forward flexibility includes a plurality of non-bifurcated shallow, substantially horizontal relief grooves at said front ankle area of said liner.

8. In a boot system incorporating a pliable inner liner within a relatively rigid outer shell, an improved inner liner comprising:

leg and ankle areas, each having inner side, outer side, front, and back portions, a foot area having top, bottom, toe, heel, inner side, and outer side portions, and a substantially smooth interior surface;

said inner liner being configured as a tongueless boot and including a single bifurcation through said outer side of said leg and ankle areas and said outer side and top of said foot area, said bifurcation being constructed and arranged to permit said inner liner to be adjusted selectively to open and closed positions, respectively, and comprising first and second edges, said edges being approximately juxtaposed when said inner liner is placed into said closed position, whereby to form a substantially ridge free seam.

9. An improved inner liner according to claim 8, including:

intercooperable structural means carried by said first and second edges respectively, said structural means mutually adapted for achieving said ridge free seam when said inner liner is in said closed position.

10. An improved inner liner according to claim 9, wherein said means for achieving said ridge free seam comprises:

said first edge of said bifurcation overlapping said second edge of said bifurcation, the overlapping portion of said first edge being received by a recessed portion of said second edge.

11. An improved inner liner according to claim 8, including means for providing enhanced forward flexibility from said ankle area of said liner.

12. An improved inner liner according to claim 11, wherein said means for providing enhanced forward flexibility includes at least one non-bifurcated relief structure at said front ankle area of said liner.

13. An improved inner liner according to claim 11, wherein said means for providing enhanced forward flexibility includes a plurality of non-bifurcated shallow, substantially horizontal relief grooves at said front ankle area of said liner.

14. In combination, an improved inner liner according to claim 8 and fitting structure associated with said inner liner, said fitting structure being constructed and arranged to be positioned adjacent an outside surface of said inner liner.

15. A combination according to claim 14, further including:

a rigid outer shell constructed and arranged to receive said inner liner and said fitting structure so that said fitting structure is positioned between an inner surface of said outer shell and an outer surface of said inner liner.

16. A combination according to claim 15 including means for providing enhanced forward flexibility from said ankle area of said liner comprising at least one non-bifurcated relief structure integral with at least one of said leg and ankle front and foot top areas of said inner liner.

17. A combination according to claim 16, wherein said means for providing enhanced forward flexibility includes a plurality of non-bifurcated shallow, substantially horizontal relief grooves at said front ankle area of said liner.

18. A combination according to claim 15, including:

mechanical means carried by said outer shell for urging said first and second edges into position to form said ridge free seam when said inner liner is in said closed position.

19. A combination according to claim 18, wherein said ridge free seam is formed by said first edge of said bifurcation overlapping said second edge of said bifurcation, the overlapping portion of said first edge being received by a recessed portion of said second edge.

20. In a boot system incorporating a pliable inner liner within a relatively rigid outer shell, an improved inner liner comprising:

leg and ankle areas each having:

inner side, outer side, front, and back exterior surfaces, a foot area having top, bottom, toe, heel, inner side, and outer side portions, and a substantially smooth interior surface;

said smooth interior surface being interrupted by a single bifurcation at said outer side of said leg and ankle areas and said outer side and top of said foot area, said interior surface otherwise being free of any other bifurcations or raised or indented features when said inner liner is either in a relaxed or in a flexed position.

21. A boot system according to claim 20, wherein:

said inner liner is configured as a tongueless boot and includes said single bifurcation through said outer side of said leg and ankle areas and said outer side and top of said foot area, said bifurcation being constructed and arranged to permit said inner liner to be adjusted selectively to open and closed positions, respectively, and comprising first and second edges, said edges being approximately juxtaposed when said inner liner is placed into said closed position, whereby to form a substantially ridge free seam.

* * * * *